US006289965B1

(12) United States Patent
Ruggles

(10) Patent No.: US 6,289,965 B1
(45) Date of Patent: Sep. 18, 2001

(54) TAKE-UP DRUM FOR A CORDLESS SHADE COUNTERBALANCE

(75) Inventor: Bryan K. Ruggles, South Lake City, UT (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/502,733

(22) Filed: Feb. 11, 2000

(51) Int. Cl.[7] ..... E06B 9/322

(52) U.S. Cl. ..... 160/170 R; 160/84.04; 160/173 R; 242/373; 242/378.4

(58) Field of Search ..... 160/168.1 P, 176.1 P, 160/84.02, 84.06, 84.01, 84.04, 170 R, 173 R; 185/39, 45; 242/378.4, 373

(56) References Cited

U.S. PATENT DOCUMENTS

| | | |
|---|---|---|
| 13,251 | 7/1855 | Bixler . |
| 322,732 | 7/1885 | Lang . |
| 842,401 | 1/1907 | Goodell . |
| 927,090 | 7/1909 | Anderson . |
| 948,239 | 2/1910 | McManus . |
| 1,636,601 | 7/1927 | Givens . |
| 1,721,501 | 7/1929 | McKee . |
| 1,731,124 | 10/1929 | Carper . |
| 1,789,655 | 1/1931 | Iwata . |
| 1,951,659 | 2/1934 | Kesner . |
| 2,037,393 | 4/1936 | Roberts . |
| 2,049,518 | 8/1936 | Schier . |
| 2,110,983 | 3/1938 | Carver . |
| 2,175,549 | 10/1939 | Nardulli et al. . |
| 2,250,106 | 7/1941 | Lorentzen . |
| 2,260,101 | 10/1941 | De Falco . |
| 2,266,160 | 12/1941 | Burns . |
| 2,276,716 | 3/1942 | Cardona . |
| 2,324,536 | 7/1943 | Pratt . |
| 2,325,992 | 8/1943 | Wirthman . |
| 2,350,094 | 5/1944 | Butts . |
| 2,390,826 | 12/1945 | Cohn . |
| 2,410,549 | 11/1946 | Olson . |
| 2,420,301 | 5/1947 | Cusumano . |
| 2,509,033 | 5/1950 | Carver . |
| 2,520,629 | 8/1950 | Esposito . |
| 2,535,751 | 12/1950 | Nardulli . |
| 2,598,887 | 6/1952 | Burns . |
| 2,687,769 | 8/1954 | Gershuny . |
| 2,824,608 | 2/1958 | Etten . |
| 2,869,801 * | 1/1959 | Foster . |
| 2,874,612 | 2/1959 | Luboshez . |
| 3,141,497 | 7/1964 | Griesser . |
| 3,371,700 | 3/1968 | Romano . |
| 3,485,285 | 12/1969 | Anderle . |
| 3,487,875 | 1/1970 | Shukat et al. . |
| 3,756,585 | 9/1973 | Mihalcheon . |
| 3,817,309 | 6/1974 | Takazawa . |
| 4,157,108 | 6/1979 | Donofrio . |
| 4,205,816 | 6/1980 | Yu . |
| 4,223,714 | 9/1980 | Weinreich et al. . |
| 4,326,577 | 4/1982 | Tse . |

(List continued on next page.)

FOREIGN PATENT DOCUMENTS 0 796 994 A2 9/1997 (EP) .

* cited by examiner

*Primary Examiner*—Blair M. Johnson
(74) *Attorney, Agent, or Firm*—Marshall, Gerstein & Borun

(57) ABSTRACT

A spring motor with an improved take-up drum and idler gear assembly is disclosed. The spring motor includes a take-up drum proximate a drive drum with a coil spring interconnected between the two. First and second cord spools are mounted for rotation laterally adjacent the drive drum and take-up drum. The take-up drum is mounted about an idler gear which transfers torque from the first cord spool to the drive drum. Both the take-up drum and the idler gear are independently rotatable and are supported for rotation on first and second respective sides of each to thereby minimize binding between the idler gear and the take-up drum.

20 Claims, 3 Drawing Sheets

U.S. PATENT DOCUMENTS

| | | | |
|---|---|---|---|
| 4,344,474 | | 8/1982 | Berman . |
| 4,398,585 | | 8/1983 | Marlow . |
| 4,427,163 | * | 1/1984 | Kindziola . |
| 4,574,864 | | 3/1986 | Tse . |
| 4,610,292 | | 9/1986 | Hausmann et al. . |
| 4,623,012 | | 11/1986 | Rude et al. . |
| 4,625,786 | | 12/1986 | Carter et al. . |
| 4,647,488 | | 3/1987 | Schnebly et al. . |
| 4,726,410 | | 2/1988 | Fresh . |
| 4,852,627 | | 8/1989 | Peterson et al. . |
| 4,856,574 | | 8/1989 | Minami et al. . |
| 4,862,941 | | 9/1989 | Colson . |
| 4,877,075 | | 10/1989 | Markowitz . |
| 4,880,045 | | 11/1989 | Stahler . |
| 4,955,421 | | 9/1990 | Torti . |
| 4,984,617 | | 1/1991 | Corey . |
| 5,054,162 | | 10/1991 | Rogers . |
| 5,083,598 | | 1/1992 | Schön . |
| 5,103,888 | | 4/1992 | Nakamura . |
| 5,105,867 | * | 4/1992 | Coslett . |
| 5,133,399 | | 7/1992 | Hiller et al. . |
| 5,141,041 | | 8/1992 | Katz et al. . |
| 5,157,808 | | 10/1992 | Sterner, Jr. . |
| 5,170,830 | * | 12/1992 | Coslett . |
| 5,184,660 | | 2/1993 | Jelic . |
| 5,228,491 | | 7/1993 | Rude et al. . |
| 5,313,998 | | 5/1994 | Colson et al. . |
| 5,318,090 | | 6/1994 | Chen . |
| 5,363,898 | | 11/1994 | Sprague . |
| 5,391,967 | | 2/1995 | Domel et al. . |
| 5,413,161 | | 5/1995 | Corazzini . |
| 5,482,100 | | 1/1996 | Kuhar . |
| 5,485,875 | | 1/1996 | Genova . |
| 5,531,257 | | 7/1996 | Kuhar . |
| 5,706,876 | | 1/1998 | Lysyj . |
| 5,813,447 | | 9/1998 | Lysyj . |
| 6,149,094 | * | 11/2000 | Martin et al. . |

FIG. 5
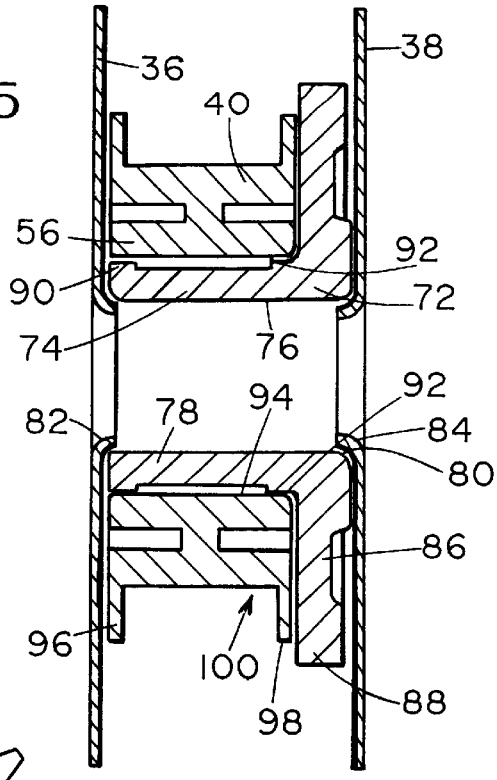
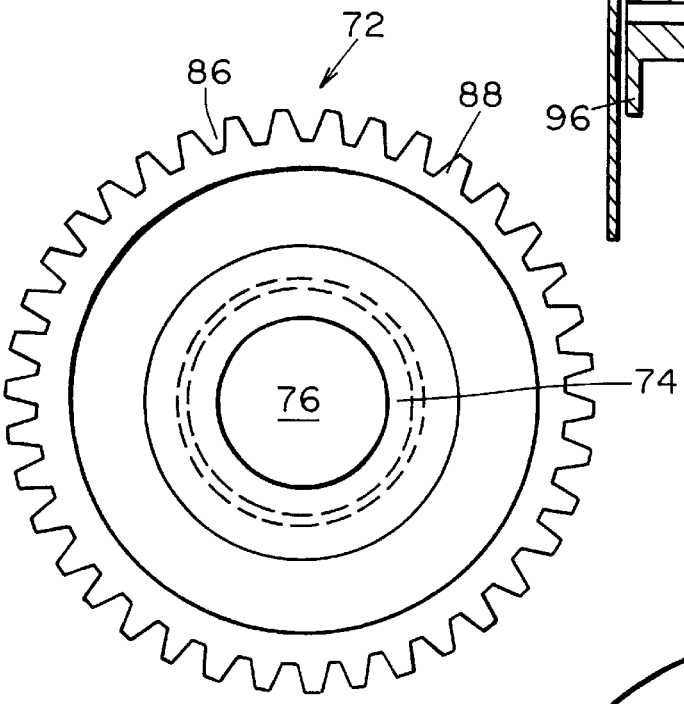
FIG. 6
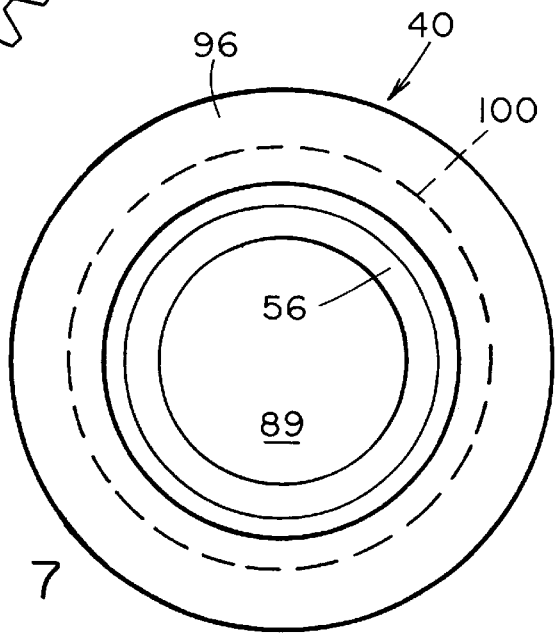
FIG. 7

TAKE-UP DRUM FOR A CORDLESS SHADE COUNTERBALANCE

FIELD OF THE INVENTION

The present invention generally relates to counterbalances, and more particularly relates to take-up drums for use with spring motors.

BACKGROUND OF THE INVENTION

Spring motors are well-known and generally comprise a flat ribbon of spring metal which is pre-stressed on one side and coiled so as to have a natural or relaxed state in which the spring forms a tightly wound coil. The coil is normally disposed on or in a storage or take-up drum. The free end of the coil is attached to the hub of an output or drive drum onto which the spring is back wound by rotating the output drum in the direction to back wind the spring thereon. When the holding force by which the spring is back wound on the output drum is released, the curling property of the spring rewinds the latter onto or into the storage or take-up drum towards its natural or relaxed state. This resulting motion can be utilized in a number of applications requiring reciprocating motion such as with seat belts, cordless blinds and the like.

The spring member in such spring motors can be of constant or variable force depending upon the intended use for the motor. The variable force characteristic can be obtained in a number of ways including tapering the width and or thickness of the spring as disclosed in U.S. Pat. Nos. 5,482,100 and 5,531,257. Such patents are directed to the use of spring motors in conjunction with a cordless window blind.

In the aforementioned patents, a cord drum is provided lateral to, and concentric with, the drive drum such that rotation of the cord spool causes rotation of the drive drum. Rotation of the drive drum in turn uncoils the spring from the take-up drum and back winds the spring onto the drive drum. A cord is connected between the cord drum and the bottom rail of the blind. When the blind is extended downwardly, this rotation pulls the cord from the cord spool which in turn rotates the cord spool, the drive drum, and the take-up drum. The spring motor facilitates smooth motion of the bottom rail.

In still further devices, the cord spool or spools are provided in a linear arrangement with the axis of the take-up drum, drive drum and cord spools being parallel. Typically, two cord spools are provided, one adjacent the drive drum, and one adjacent the take-up drum. In order to transfer torque from the cord spools to the drive drum, the cord spools are provided with radially extending gear teeth which mesh with mating teeth on the drive drum. In one case, the cord spool teeth mesh with teeth of an idler gear mounted proximate the take-up drum, and the idler gear then meshes with the drive drum. The take-up drum and idler gear are mounted on the same axis and concentric with one another, with the take-up drum being provided with a recess on one side about which the idler gear rotates.

While such systems are workable, the idler gear and take-up drum can tend to bind and not freely rotate, which necessarily detrimentally affects performance of the coil spring. More specifically, if the take-up drum is not allowed to freely rotate, the coil can tend to "grow" in that it is not tightly wound about the take-up drum. As a result the coil spring loses force and may become disengaged from the take-up drum. Such binding can occur because the rotational force on the gear necessarily side loads the axle or hub or around which it rotates causing excess friction and/or disproportionate rotation of the idler spool.

SUMMARY OF THE INVENTION

In accordance with one aspect of the invention, a spring motor is provided which comprises a frame, a drive drum rotatably mounted to the frame, an idler gear rotatably mounted to the frame, a take-up drum rotatably mounted and concentric with the idler gear, and a coil spring interconnected between the take-up drum and the drive drum. The idler gear is operably connected to the drive gear such that rotation of the idler gear causes rotation of the drive drum. The idler gear is rotatable independent of the take-up drum and the coil spring is biased into a wound orientation on the take-up drum.

In accordance with other aspects of the invention, the idler gear includes a cylindrical hub with first and second ends, and a toothed flange radially extending from the first end. The first and second ends are rotationally supported by the frame with the take-up drum being rotationally supported on the cylindrical hub. A cylindrical hub includes first and second laterally spaced bearing surfaces around which the take-up drum rotates.

In accordance with another aspect of the present invention, a blind is provided comprising a head rail, a bottom rail, a plurality of slats between the head rail and the bottom rail, at least one cord interconnecting the head rail, bottom rail and the plurality of slats, and a spring motor mounted in one of the head rail and bottom rail. The spring motor comprises a frame, a drive drum rotatably mounted to the frame, an idler gear rotatably mounted to the frame and operably connected to the drive gear, at least one cord spool rotatably mounted to the frame and operably connected to the idler gear, a take-up drum rotatably mounted on, and concentric with, the idler gear, and a coil spring interconnected between the take-up drum and the drive drum. Rotation of the idler gear causes rotation of the drive drum, rotation of the cord spool causes rotation of the idler gear, and the idler gear is rotatable independent of the take-up drum. The at least one cord is connected to the at least one cord spool. The coil spring is biased into a wound orientation on the take-up drum.

In accordance with another aspect of the present invention, an idler gear and take-up drum assembly for a spring motor is provided which comprises a central hub having a through aperture and first and second ends, a flange radially extending from the first end of the central hub, and a spool rotationally mounted onto the central hub. The central hub is adapted to support the first and second ends for rotation within the through aperture, and the spool includes a hub with first and second radially extending flanges.

In accordance with yet another aspect of the invention, a spring motor is provided which comprises a frame, a drive drum rotatably mounted to the frame, a take-up drum rotatably mounted to the frame, a coil spring interconnected between the drive drum and the take-up drum, a cord spool rotatably mounted to the frame, and means for transferring torque from the cord spool to the drive drum while permitting the take-up drum to rotate freely. The drive drum, take-up drum, and cord spool are linearly aligned with parallel axes of rotation, and with the take-up drum being interposed between the drive drum and the take-up drum.

These and other aspects and features of the invention will become more apparent from the following detailed description when taken in conjunction with the accompanying drawings.

BRIEF DESCRIPTION OF THE DRAWINGS

FIG. 5 is an end sectional view of FIG. 2 taken along the line 5—5 of FIG. 2;

FIG. 6 is a sectional view of the idler gear according to the invention; and FIG. 7 is a sectional view of the take-up drum according to the invention.

Figure 1:
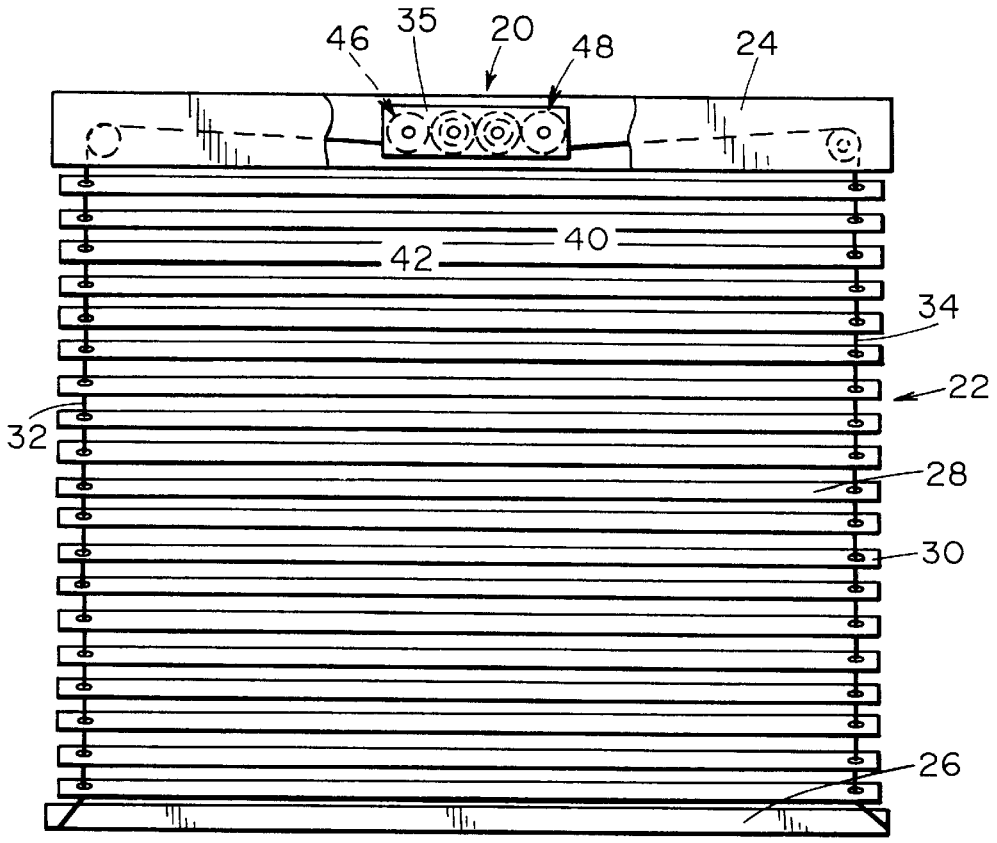
FIG. 1 is a side view of an extended blind using a spring motor in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

DETAILED DESCRIPTION OF THE PREFERRED EMBODIMENTS

Referring now to the drawings, and with specific reference to FIG. 1, a spring motor according to the invention is generally depicted by reference numeral 20. As shown therein, one use to which the spring motor 20 is particularly well suited is in conjunction with a shade or blind 22. The blind 22 typically includes a head rail 24, a base rail 26, and an expandable window covering 28 therebetween. The window covering 28 typically includes a plurality of slats 30 positioned on ladder cords (now shown), with first and second take-up cords 32, 34 being connected to the base rail and passing through each of the slats 30.

Such a blind 22 is typically referred to as a "cordless" blind in that while the first and second take-up cords 32 and 34 are provided, the first and second cords 32 and 34 are not graspable by the user as with conventional venetian blinds. Rather, with such a cordless blind, the user simply lifts up, or pushes down, upon the base rail 26 to move the blind 22 to the particular desired position. The spring motor 20 facilitates this process by allowing for smooth movement of the base rail 26 while maintaining a horizontal orientation regardless of the lateral position upon the base rail 26 which the user grasps.

Figure 2:
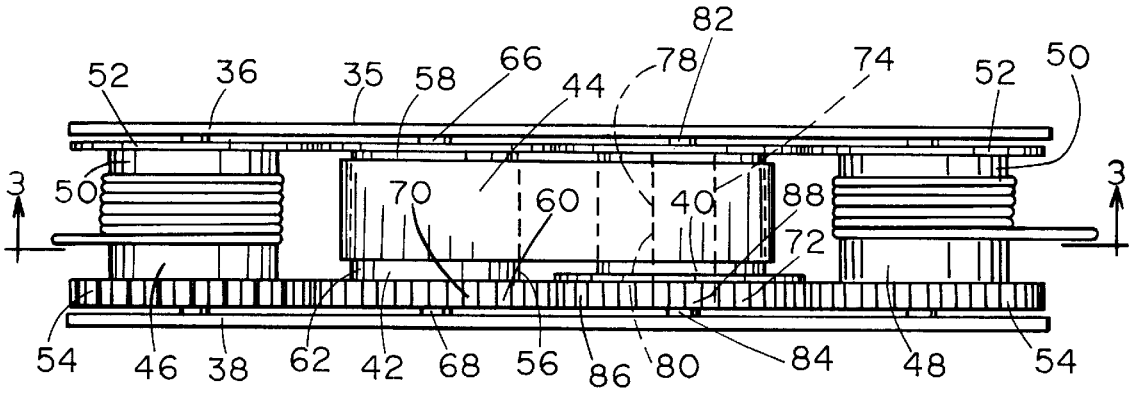
FIG. 2 is a top view of the spring motor of FIG. 1.

Referring now to FIG. 2, the spring motor 20 is shown in further detail. The spring motor 20 includes a frame 35 having first and second side walls 36 and 38. A take-up drum 40, and a drive drum 42 are mounted for rotation between the first and second side walls 36 and 38. A coil spring 44 is interconnected between the take-up drum 40 and drive drum 42, with its biased or relaxed position being wound upon the take-up drum 40.

First and second cord spools 46 and 48 are also mounted for rotation between the first and second side walls 36 and 38 and, as shown, are laterally outside of the take-up drum 40 and drive drum 42. The first cord spool 46 is connected to the first cord 32, whereas the second cord spool 48 is connected to the second cord 34. Therefore, upon the user pulling downwardly upon the base rail 26, the first and second cords 32 and 34 are pulled or unwound from the first and second cord spools 46 and 48. Each of the cord spools 46 and 48 includes a central hub 50 from which a flange 52 radially extends from one side, and a toothed gear wheel 54 extends from the other side. Therefore, rotation of the first and second cord spools 46 and 48 causes rotation of the toothed gear wheel 54.

Figure 3:
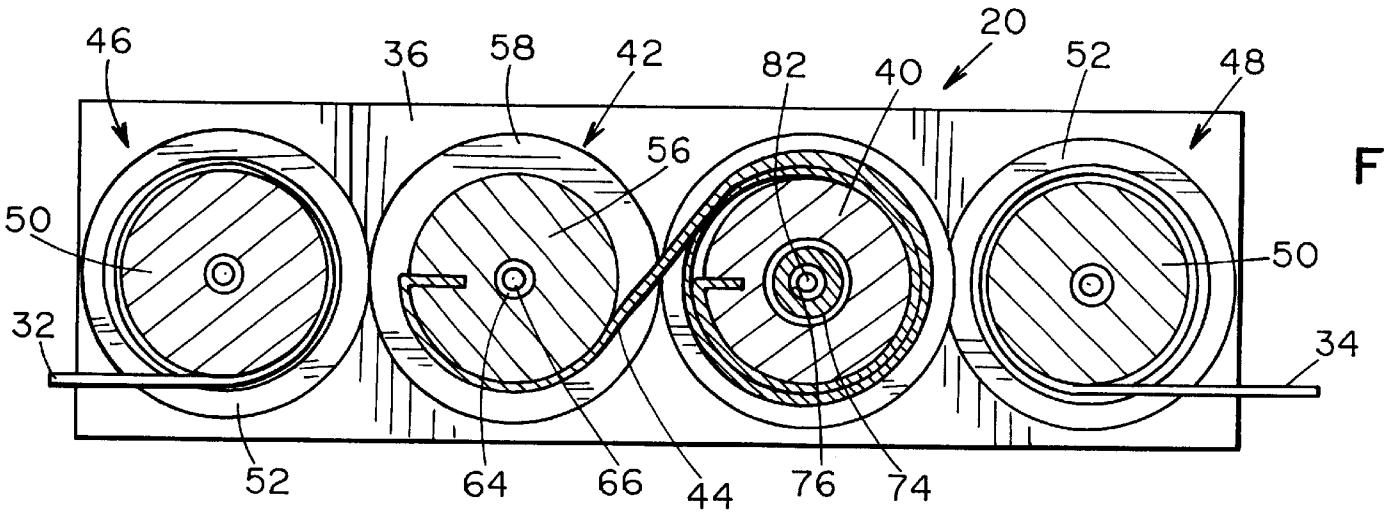
FIG. 3 is a side sectional view of FIG. 2 taken along line 3—3 of FIG. 2.
Figure 4:
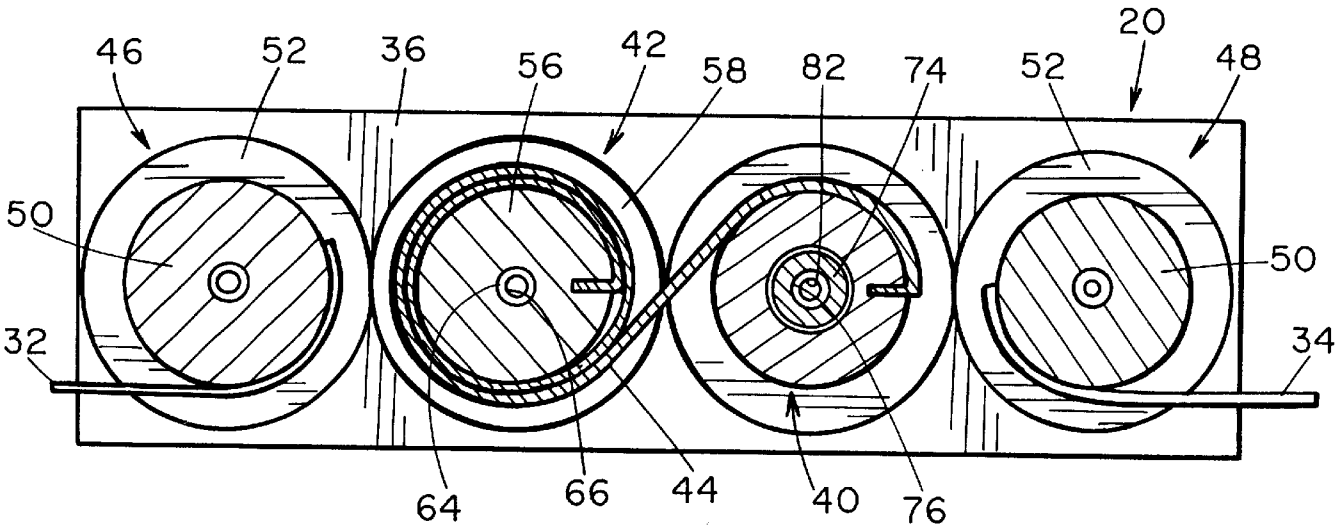
FIG. 4 is a side sectional view of FIG. 2 taken along line 3—3 of FIG. 2 but with the coil spring being unwound.

With specific reference to the drive drum 42, it can be seen from FIGS. 2–4 that the drive drum 42 includes a central hub 56 from which first and second flanges 58 and 60 radially extend to thereby define an annular channel 62 therebetween for receipt of the coil spring 44. The central hub 56 includes a through aperture 64 (FIG. 3) which is supported for rotation by lips 66 and 68 inwardly extending from the frame side walls 36 and 38. The lips 66 and 68 are preferably formed by staking the side walls 36 and 38 inwardly.

In order to rotate the drive drum 42 and thus unwind the coil spring 44 from the take-up drum 40, the rotation and resulting torque from the rotating cord spools 46 and 48 must be transferred to the drive drum 42. With respect to the first cord spool 46, this can be accomplished by providing gear teeth 70 on the flange 60 of the drive drum 42 which directly mesh with the toothed gear wheel 54 of the first cord spool 46. However, with regard to the second cord spool 48, it is separated from the drive drum 42 by the take-up drum 40. Since it is necessary for the take-up drum 40 to be freely rotatable to allow the coil spring 44 to be easily unwound, a separate mechanism must be provided to transfer the torque from the second cord spool 48 to the drive drum 42, while allowing the take-up drum 40 to freely rotate. In the present invention, such a mechanism is provided in the form of an idler gear 72 which is directly mounted for rotation to the frame 34. As shown in FIGS. 5–6, the idler gear 72 includes a central hub 74 having a through aperture 76. First and second ends 78 and 80 of the central hub 74 are mounted to extruded apertures 82 and 84 inwardly extending from the side walls 36 and 38. Therefore, the idler gear 72 is mounted for rotation and supported for rotation on both the first end 78 and the second end 80, and lateral movement of the central hub 74 and idler gear 72 is minimized.

The idler gear 72 also includes a side flange 86 extending from the second end 80 with a plurality of gear teeth 88 extending therefrom. The gear teeth 88 mesh with the toothed gear wheel 54 of the second cord spool 48 and transfers torque from the second cord spool 48 to the drive drum 42.

In order to allow for the take-up drum 40 to rotate independently and freely of the idler gear 72, it can be seen from FIG. 5 that the take-up drum 40 is mounted for rotation about the central hub 74 of the idler gear. The take-up drum 40 is therefore concentric with the idler gear 72. More specifically, a central aperture 89 of the central hub 56 of the take-up drum 40 is mounted around the central hub 74 of the idler gear 72. In order to minimize friction between the idler gear 72 and the take-up drum 40, the idler gear 72 includes first and second bearing surfaces 90 and 92 radially extending from the central hub 74 at the first and second ends 78 and 80. As shown in FIG. 5, a recess 94 exists between the first and second bearing surfaces 90 and 92 at which the take-up drum 40 is not in engagement with the idler gear 72. The bearing surfaces 90 and 92 also ensure support for the take-up drum of each end of the aperture 89 to thus minimize lateral cocking or binding. The take-up drum includes first and second side flanges 96 and 98 defining a channel 100 for receipt of the coil spring 44.

In operation, it can therefore be seen that when the base rail 26 is pulled downwardly away from the head rail 24, the first and second cords 32 and 34 are pulled with the base rail 26. This motion in turn causes the first and second cord spools 46 and 48 to rotate. Rotation of the first and second cords spools 46 and 48 in turn directly causes rotation of the idler gear 72 and drive drum 42, respectively. The idler gear 72 in turn contributes to rotation of the drive drum 42. The rotation of the idler gear 72 is independent of the take-up drum 40 in that the take-up drum 40 and idler gear 72 are separately mounted and the take-up drum 40 rotates only when the coil spring 44 is pulled therefrom, or released after being pulled therefrom. As the base rail 26 is pulled downwardly, the rotation of the drive drum 42 causes the coil spring 44 to be unwrapped from the take-up drum 40 and onto the drive drum 42. This ensures smooth motion of the base rail 26 regardless of the exact position at which the user pulls downwardly upon the base rail 26.

When it is desired to move the base rail 26 back toward the head rail 24, the coil spring 44 facilitates smooth motion by recoiling back on to the take-up drum 40. This rotation of the take-up drum 40 rotates the drive drum 42 which in turn rotates the idler gear 72, and the first and second cord spools 46 and 48 to wrap the first and second cords 32 and 34 thereon. Rotation of the idler gear 72 and take-up drum 40 is therefore smooth, independent, and conducted with minimized binding.

From the foregoing, it can therefore be seen that the invention provides a spring motor for a blind having an improved take-up drum and idler gear assembly with reduced susceptibility to binding and enhanced operation.

What is claimed is:

1. A spring motor, comprising:

a frame;

a drive drum rotatably mounted to the frame;

an idler gear rotatably mounted to the frame and operably connected to the drive drum, rotation of the idler gear causing rotation of the drive drum;

a take-up drum rotatably mounted on, and concentric with, the idler gear, the idler gear being rotatable independently of the take-up drum; and a coil spring interconnected between the take-up drum and the drive drum, the coil spring being biased into a wound orientation on the take-up drum.

2. The spring motor of claim 1 wherein the idler gear includes a cylindrical hub with first and second ends and a toothed flange radially extending from the first end, the first and second ends both being rotationally supported by the frame, the take-up drum being rotationally supported on the cylindrical hub.

3. The spring motor of claim 2 wherein the cylindrical hub includes first and second laterally spaced bearing surfaces around which the take-up drum rotates.

4. The spring motor of claim 2 wherein the take-up drum includes a cylindrical hub and a pair of laterally spaced, radially extending side flanges defining an annular channel for receipt of the coil spring.

5. The spring motor of claim 1 wherein the frame includes first and second opposed sides, with first and second opposed pairs of inwardly directed extruded apertures being provided in the first and second sides the drive drum being rotationally journalled on the first pair of extruded apertures, the idler gear being rotationally journalled on the second pair of extruded apertures.

6. The spring motor of claim 1 further including at least one cord spool rotatably mounted to the frame, the cord spool being operably connected to the idler gear, rotation of the cord spool causing rotation of the idler gear.

7. A blind, comprising:

a head rail;

a bottom rail;

an expandable window covering between the head rail and the bottom rail;

at least one cord interconnecting the head rail, bottom rail, and expandable window covering;

a spring motor mounted in one of the head rail and bottom rail, the spring motor comprising:

a frame;

a drive drum rotatably mounted to the frame;

an idler gear rotatably mounted to the frame and operably connected to the drive drum, rotation of the idler gear causing rotation of the drive drum;

at least one cord spool rotatably mounted to the frame and operably connected to the idler gear, rotation of the cord spool causing rotation of the idler gear, the at least one cord being connected to the at least one cord spool;

a take-up drum rotatably mounted on, and concentric with, the idler gear, the idler gear being rotatable independently of the take-up drum; and a coil spring interconnected between the take-up drum and the drive drum, the coil spring being biased into a wound orientation on the take-up drum.

8. The blind of claim 7 wherein the idler gear includes a cylindrical hub with first and second ends and a toothed flanged radially extending from the first end, the first and second ends both being rotationally supported by the frame, the take-up drum being rotationally supported on the cylindrical hub.

9. The blind of claim 8 wherein the take-up drum includes a cylindrical hub and a pair of laterally spaced radially extending side flanges defining an annular channel for receipt of the coil spring.

10. The blind of claim 7 wherein the cylindrical hub includes first and second laterally spaced bearing surfaces around which the take-up drum rotates.

11. The blind of claim 7 wherein the frame includes first and second opposed sides, with first and second opposed pairs of inwardly directed lips being provided in the first and second sides, the drive drum being rotationally journalled on the first pair of lips, the idler gear being rotationally journalled on the second pair of lips.

12. The blind of claim 11 wherein the inwardly directed lips are formed by staking the sides of the frame.

13. The blind of claim 7 including first and second cord drums, the first cord drum being in direct contact with the idler gear, the second drum being in direct contact with the drive drum, the blind further including first and second cords, the first cord connecting a first side of the blind to the first cord spool, the second cord connecting a second side of the blind to the second cord spool.

14. The blind of claim 13 wherein the first cord spool, the idler gear, the drive drum, and the second cord drum are linearly aligned with parallel axes, and are interconnected by gear teeth.

15. The blind of claim 7 wherein the expandable window covering includes a plurality of slats.

16. A spring motor, comprising:

a frame;

a drive drum rotatably mounted to the frame;

a take-up drum rotatably mounted to the frame;

a coil spring interconnected between the drive drum and the take-up drum;

a cord spool rotatably mounted to the frame, the drive drum, take-up drum and cord spool being linearly aligned with parallel axes of rotation, the take-up drum being interposed between the drive drum and the cord spool; and an idler gear rotatably mounted to the frame and including a cylindrical hub and a radially extending flange, the take-up drum being rotatably mounted to the cylindrical hub.

17. The spring motor of claim 16 wherein the radially extending flange includes a plurality of gear teeth meshed with gear teeth extending from the drive drum and cord spool.

18. The spring motor of claim 17 wherein the cylindrical hub includes first and second laterally spaced bearing surfaces supporting the take-up drum for rotation.

19. The spring motor of claim 17 wherein the cylindrical hub includes first and second cords, the first and second ends being supported for rotation by the frame.

20. The spring motor of claim 19 wherein the frame includes first and second sides, each side including an extruded aperture providing support for the central hub.

* * * * *